US007082792B2

(12) United States Patent
Ahn

(10) Patent No.: US 7,082,792 B2
(45) Date of Patent: Aug. 1, 2006

(54) WASHING MACHINE

(75) Inventor: In Geun Ahn, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 482 days.

(21) Appl. No.: 10/257,331

(22) PCT Filed: Feb. 19, 2002

(86) PCT No.: PCT/KR02/00258

§ 371 (c)(1),
(2), (4) Date: Oct. 10, 2002

(87) PCT Pub. No.: WO02/066725

PCT Pub. Date: Aug. 29, 2002

(65) Prior Publication Data

US 2003/0115914 A1 Jun. 26, 2003

(30) Foreign Application Priority Data

Feb. 19, 2001 (KR) ..... 2001-8246

(51) Int. Cl.
*D06F 37/30* (2006.01)
*D06F 33/00* (2006.01)

(52) U.S. Cl. ..... 68/12.24; 68/23.6; 68/133

(58) Field of Classification Search ..... 68/23.6, 68/23.7, 133, 12.24; 192/17 C, 17 D, 18 R, 192/18 B, 12 D, 69.8, 71, 79, 84.6
See application file for complete search history.

(56) References Cited

U.S. PATENT DOCUMENTS 2,331,897 A 10/1943 Dyer
2,462,657 A 2/1949 McNairy
2,656,702 A 10/1953 Chapin
2,969,665 A 1/1961 Saverio
5,150,589 A 9/1992 Williams et al.
5,208,931 A 5/1993 Williams et al.
5,403,882 A * 4/1995 Huggins ..... 524/406
5,586,455 A 12/1996 Imai et al.
5,737,944 A * 4/1998 Nishimura et al. ..... 68/23.7
5,778,703 A * 7/1998 Imai et al. ..... 68/12.02
5,884,507 A 3/1999 Lee et al.

(Continued)

FOREIGN PATENT DOCUMENTS

CN 1224784 A 8/1999

(Continued)

*Primary Examiner*—Joseph L. Perrin
(74) *Attorney, Agent, or Firm*—McKenna Long & Aldridge LLP

(57) ABSTRACT

A washing machine is disclosed, in which a rotatory power of a driving unit can be stably transmitted in a short time and provided to a pulsator or a washing tub. The washing machine includes a motor (7) including stator (7*a*) and rotor (7*b*), a hollow spinning shaft (5) of which an upper end is connected to the washing tub (2), a washing shaft (4) connected to the pulsator (3) of which an upper end is installed within the washing tub, solders (31) and (35) moving up and down according to an outer surface of the spinning shaft and selectively transmitting the rotatory power of the rotor to the spinning shaft, and actuator (6) guiding up and down movements of the sliders, a power transmission means between the actuator and the slider to convert a power of the actuator and to transmit the power to the slider, and an attenuating means between the actuator and the slider to delay the power generated in the actuator and to transmit the power to the slider.

11 Claims, 9 Drawing Sheets

U.S. PATENT DOCUMENTS

| | | | | |
|---|---|---|---|---|
| 5,887,458 | A * | 3/1999 | Bae | 68/23.7 |
| 6,049,930 | A * | 4/2000 | Hisano et al. | 8/159 |
| 6,060,851 | A | 5/2000 | Imai et al. | |
| 6,148,646 | A * | 11/2000 | Koshiga et al. | 68/23.7 |
| 6,176,108 | B1 * | 1/2001 | Bae et al. | 68/23.7 |
| 6,194,894 | B1 * | 2/2001 | Apel et al. | 324/207.25 |
| 6,202,451 | B1 * | 3/2001 | Park et al. | 68/23.7 |
| 6,257,027 | B1 | 7/2001 | Imai | |
| 6,318,133 | B1 * | 11/2001 | Koshiga et al. | 68/23.7 |
| 6,332,343 | B1 | 12/2001 | Koketsu et al. | |
| 6,354,115 | B1 | 3/2002 | Zahn | |
| 6,470,714 | B1 * | 10/2002 | Koshiga et al. | 68/23.7 |
| 6,546,762 | B1 * | 4/2003 | Koshiga et al. | 68/23.7 |
| 2002/0166349 | A1 * | 11/2002 | Lim et al. | 68/23.7 |
| 2003/0131636 | A1 * | 7/2003 | Lim et al. | 68/23.7 |

FOREIGN PATENT DOCUMENTS

| | | |
|---|---|---|
| EP | 239261 | 9/1987 |
| JP | 03-111092 | 5/1991 |
| JP | 04-256796 | 9/1992 |
| JP | 11-244577 | 9/1999 |
| JP | 11347289 | 12/1999 |
| JP | 2000-70588 | 3/2000 |
| JP | 2000-279692 | 10/2000 |
| JP | 2001-17783 | 1/2001 |
| KR | P0143223 B1 | 4/1998 |

* cited by examiner

WASHING MACHINE

TECHNICAL FIELD

The present invention relates to a washing machine, and more particularly, to a full automatic washing machine, in which washing and rinsing are carried out by a slow pulsator, and spinning is carried out by a fast washing tub.

BACKGROUND ART

In general, the washing machine removes various contaminants stuck to clothes, beddings, and the like, by softening action of detergents, friction caused by water circulation formed by rotation of the pulsator, and impact to laundry applied by the pulsator. Of the washing machines, the full automatic washing machine senses amount and kinds of laundry by sensors, and sets a washing method automatically, determines a water level properly with reference to the amount and kinds of the laundry, and carries washing under the control of a microcomputer.

There are the following driving types in the foregoing full automatic washing machines. First, there is a type in which a rotating power of a driving motor is transmitted by using a power transmission belt or pulley, to a washing shaft, for rotating the pulsator, or to a spinning shaft, for rotating the washing tub. In the meantime, there is a type of washing machine in which the speed of the washing tub is varied by using a BLDC motor in the washing and spinning.

In the meantime, there is a type of washing machine introduced recently, in which the power transmission path is differed even if the BLDC motor is employed, for slow rotation of the pulsator in washing, and fast rotation both of the pulsator and the washing tub in spinning, as disclosed in JP H11-347289.

However, the type of washing machine disclosed in JP H11-347289 has unstable operation caused by operation of a gear meshing clutch mechanism made by a solenoid, and noise occurred at the time of engagement of gears in a driving body.

DISCLOSURE OF INVENTION

An object of the present invention, for solving the foregoing various problems, lies on providing a washing machine, in which stable switching and transmission of a rotation power can be made from a driving part to a pulsator or a washing tub within a short time period.

To achieve the foregoing object, the present invention provides a washing machine including a motor having a stator, and a rotor rotatable by a current induced from the stator, a hollow spinning shaft having an upper end coupled with a washing tub, a washing shaft rotatably and singly fitted in a hollow part of the spinning shaft, having an upper end coupled with a pulsator fitted in the washing tub, a connector assembly fitted between the rotor and the washing shaft for transmission of a rotating force from the rotor to the washing shaft, a slider fitted to be movable up and down along an outside surface of the spinning shaft for selective transmission of the rotating force from the rotor to the spinning shaft, an actuator for producing a power for causing up and down movement of the slider, a linkage between the actuator and the slider for converting and transmitting the power from the actuator to the slider, and buffer means between the actuator and the slider for delaying the power from the actuator to the slider.

Thus, the washing machine of the present invention can supply stable rotating power to the pulsator or the washing tub with the linkage and the buffer means.

BRIEF DESCRIPTION OF DRAWINGS

The accompanying drawings, which are included to provide a further understanding of the invention, together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings. In describing the present invention, same parts will be given the same names and reference symbols, and iterative description of the parts will be omitted.

A washing machine in accordance with a first preferred embodiment of the present invention will be described with reference to FIGS. 1–5B.

Figure 1:
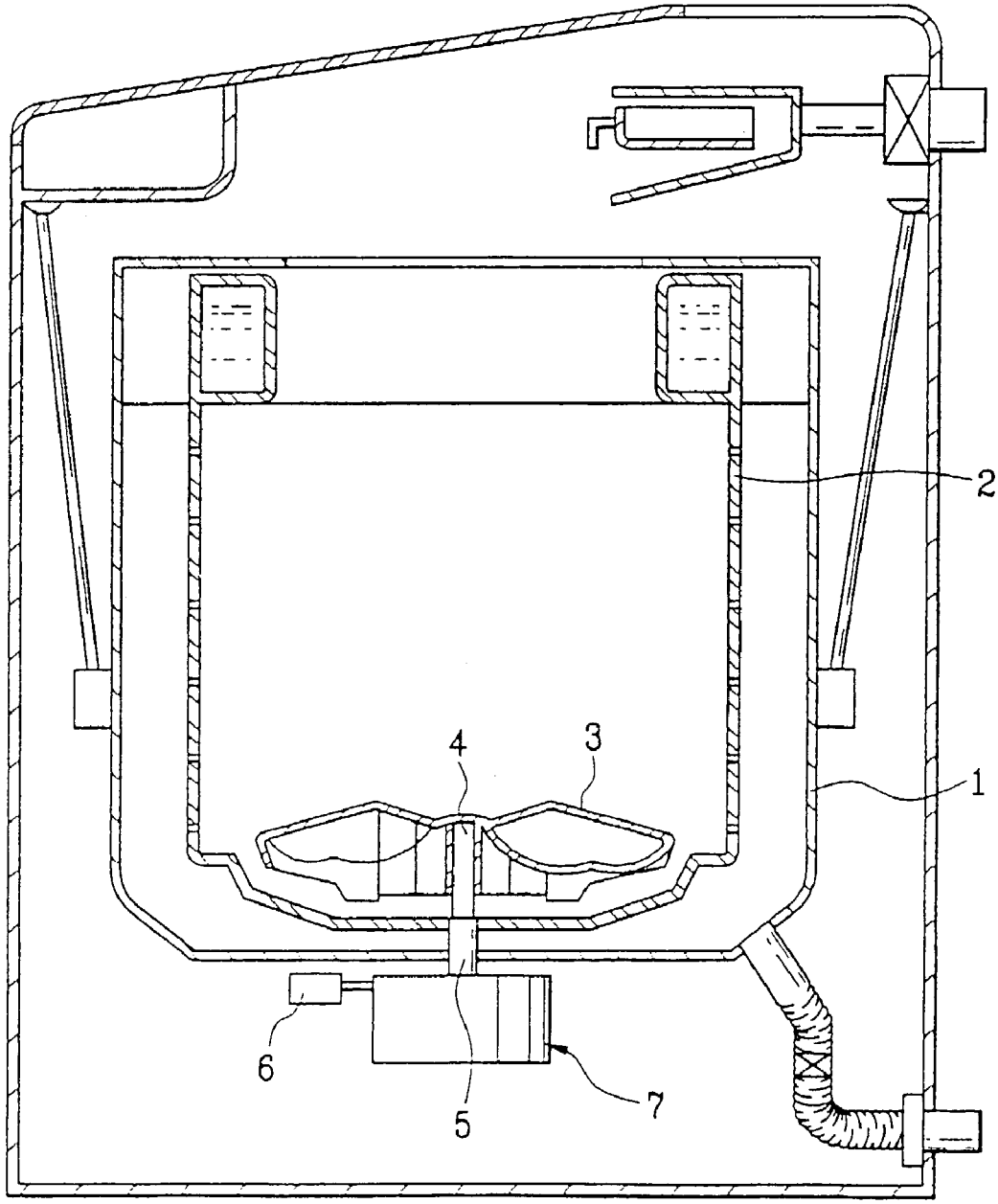
FIG. 1 illustrates a section showing a washing machine in accordance with a preferred embodiment of the present invention, schematically.

Referring to FIG. 1, the washing machine in accordance with a first preferred embodiment of the present invention includes a water storage tub 1 in a main body elastically supported from the main body, a washing tub 2 rotatably mounted in the water storage tub, a pulsator 3 rotatably fitted in the washing tub 2 independent from the washing tub 2, and a motor 7 fitted to an underside of the water storage tub 1 for rotating the washing tub 2 and the pulsator 3. There is a washing shaft 4 between the motor 7 and the pulsator 3 for transmission of a power from the motor 7 to the pulsator 3, and there is a spinning shaft 5 between the motor 7 and the washing tub 2 for transmission of power from the motor 7 to the washing tub 2.

The foregoing washing machine is required to supply the power from the motor 7 to the washing shaft 4 or the spinning shaft 5 selectively depending on a washing cycle or a spinning cycle. To do this, there is a power switching device between the washing shaft 4 and spinning shaft 5 and the motor 7, for switching a power transmission path of the motor 7, to transmit the power of the motor 7 to the washing shaft 4 or to the spinning shaft 5, selectively.

The structure and operation of the washing machine and the power switching device in accordance with a first preferred embodiment of the present invention will be explained, in detail.

Figure 2:
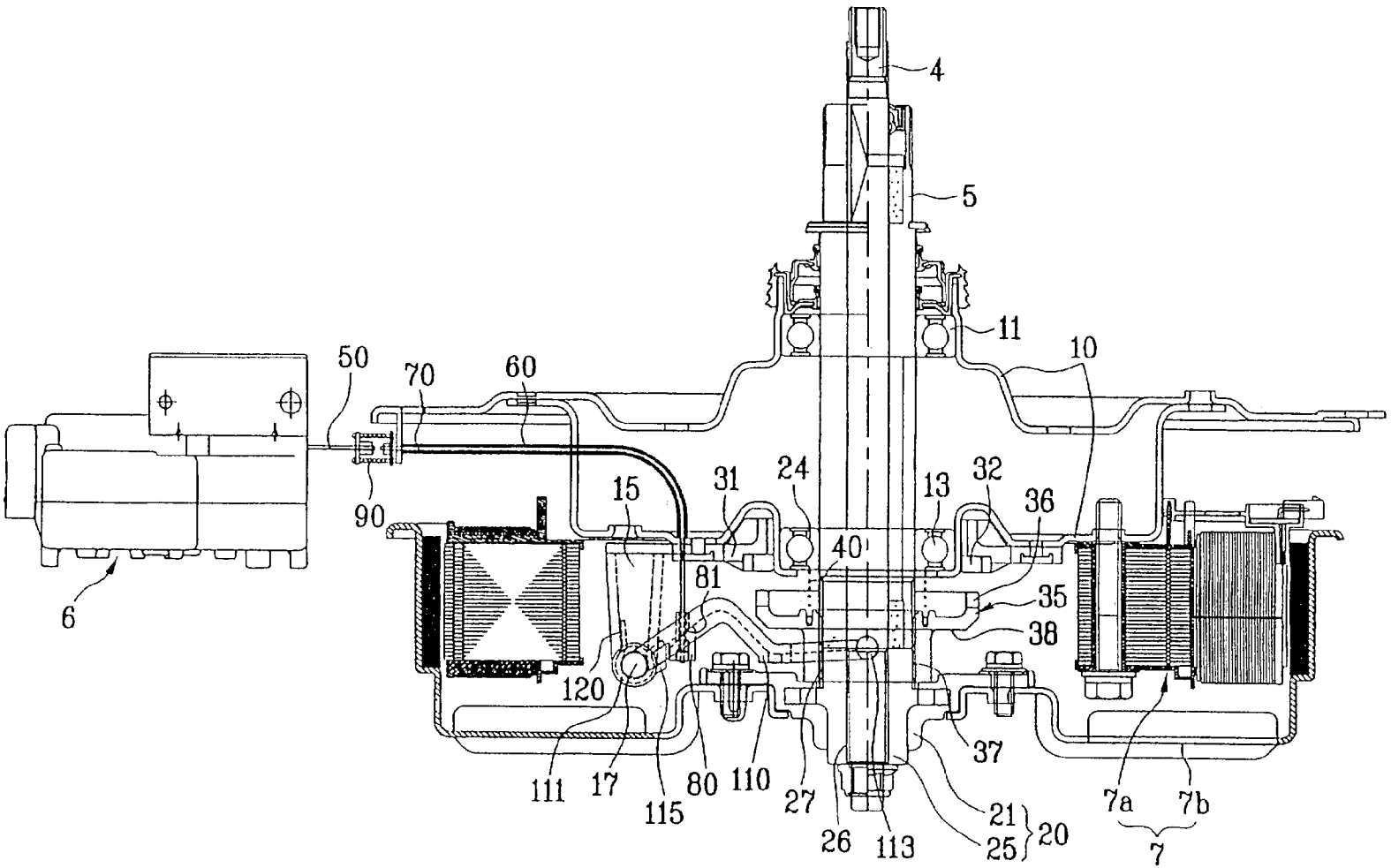
FIG. 2 illustrates a section showing a power switching device in a washing machine in accordance with a first preferred embodiment of the present invention.

Referring to FIG. 2, the washing machine in accordance with a first preferred embodiment of the present invention includes a motor 7 having a stator 7*a*, and a rotor 7*b* rotatable by a current induced thereto by the stator, a hollow spinning shaft 5 having a upper end coupled to the washing tub, and a washing shaft 4 rotatably and singly fitted in the hollow of the spinning shaft 4 having a upper end coupled with the pulsator. There is an oiless bearing between the washing shaft 4 and the spinning shaft 5, for rotatably supporting the washing shaft 4.

The spinning shaft 5 is passed through the bearing housing 10 fitted under the washing tub. There are ball bearings 11, and 13 in an upper part and a lower part of the bearing housing 10, for rotatably supporting the spinning shaft 5.

There is a connector assembly 20 between the rotor 7*b* and the washing tub 4 for transmission of a rotating force of the rotor 7*b* to the washing shaft 4. A structure of the connector assembly 20 will be described in detail, later.

The power switching device includes one pair of sliders 31, and 35 movably fitted along an outside surface of the spinning shaft 5 for selective transmission of the rotating force from the rotor 7*b* to the spinning shaft 5, an actuator 6 for producing a power for causing up and down movement of the sliders, and a linkage between the actuator 6 and the sliders 31, and 35, for transmitting the power from the actuator 6 to the sliders. There is a buffer means between the actuator 6 and the sliders 31, and 35 for delaying the power from the actuator to the sliders.

The actuator 6 is provided under the water storage tub, and causes left and right horizontal movement of the linkage by electricity or a hydraulic power.

The sliders 31 and 35 are fixed under the bearing housing 10, inclusive of a stationary slider 31 having gear 32 fixed along an outer circumference, and a movable slider 35 coupled to the linkage to be movable in up and down directions, having a movable gear 36 fit to the gear 32 on an outside surface. The stationary slider 31 is supported on a bracket 15 fixed to the underside of the bearing housing 10.

The movable slider 35, a member moving up and down along an outer circumference of the spinning shaft 5, has serration 37 in an inside surface thereof to be selectively coupled with the spinning shaft 5 or the connector assembly 20.

There is a compression spring 40 between the movable slider 35 and the stationary slider 31 having a restoration force in a direction suppressing coupling of the movable slider and the stationary slider. That is, the compression spring 40 is fitted between a top surface of the movable slider 35 and the lower side bearing 13, to push down the movable slider 35 in a state the power is not applied to the actuator 6.

The linkage includes a wire 70 for receiving the linear movement of the actuator 6, a vertical movement member 80 connected to the wire for moving up and down, and a rotational movement link 110 coupled to the vertical movement member 80 for moving the movable slider 35 in up and down directions as the rotational movement link 110 is rotated when the vertical movement member moves.

For guiding movement of the wire 70, there is a wire guide 60 bent in a '⌉' form fixed to the bearing housing 10. Therefore, the wire guide 70, inserted in the wire guide 60, moves guided by the wire guide. There is a connecting rod 50 between one end of the wire 70 and the actuator 6. The connecting rod 50 pulls the wire 70 when power is provided to the actuator 6.

The vertical movement member 80 is connected to the other end of the wire 70, and moves up and down together with the wire 70 when the other end of the wire moves up and down by the actuator 6.

The rotational movement link 110 has one end 111 rotatably coupled to a fixing pin 17 fixed to one side of the bracket 15, and the other end 113 in contact with the movable slider 35. For inducing the up and down movement of the vertical movement member 80 into a rotational movement of the rotational movement link 110, the upper end 81 of the vertical movement member 80 has a sloped surface. Along with this, a body of the rotational movement link 110 has a sloped surface in surface to surface contact with the upper end 81 of the vertical movement member 81. Accordingly, when the vertical movement member 80 moves up by the wire 70, the upper end 81 of the vertical movement member moves along the body of the rotational movement link 110. Consequently, the rotational link 110, rotating in a counter clockwise direction around the fixing pin 17, moves the movable slider 35 upward.

There is a torsion spring 120 for assisting return of the rotational movement link 110 when the actuator 6 is turned off. The torsion spring 120 has a center inserted to an outside surface of the fixing pin 17, one end fixed to the bracket 15, and the other end coupled to the rotational movement link 110. Therefore, when the rotational movement link 110 rotates in a counter clockwise direction, the torsion spring 120 is twisted. If the force of the vertical movement link 80 supporting the rotational movement link 110 is removed when the actuator 6 is turned off, the torsion spring 120, restoring to an original state, rotates the rotational movement link 110 in a clockwise direction.

In the meantime, for limiting a moving down position of the movable slider 35 when the actuator 6 is turned off, there is a stopper 115 fitted to one side of the bracket 15 for contact with the rotational movement link 110. When the rotational movement link 110 rotates in a clockwise direction, the stopper 115 comes into contact with the rotational movement link to limit a rotation angle of the rotational movement link 110, thereby limiting moving down of the movable slider 35.

On the other hand, when the movable slider 35 moves up, and engages with the stationary slider 31, there may be a case the movable gear 36 and the stationary gear 32 are miss engaged, i.e., top parts of gear teeth of the stationary gear 32 and the movable gear 36 abut, which is defined as a momentary seizure. If the rotational movement link 110 keeps to move up the movable slider 35 in this momentary seizure state, a normal coupling of the stationary gear 32 with the movable gear 36 become more difficult. To solve this problem, it is required to delay power transmission from the actuator 6 to the movable slider 35 momentarily, and one that can carry out such a function is buffer means.

As the buffer means, a buffer spring 90 fitted between the connecting rod 50 and the wire 70 is suggested. The buffer spring 90 transmits movement of the connecting rod 50 to the wire 70 as it is under a normal operation state, and, under the momentary seizure state, the buffer spring 90 is extended to absorb movement of the connection rod 50 temporarily, and transmits to the wire 70. To do this, it is required that an elastic modulus of the buffer spring 110 is greater than an elastic modulus of the torsion spring 120. Therefore, in a normal operation state, because the buffer spring 100 has an elastic modulus greater than the torsion spring 120, the buffer spring 100 receives movement of the connecting rod 50, and transmits to the wire 70 without being deformed. In the momentary seizure state, the buffer spring 100 is extended, and absorbs the movement, thereby stopping transmission of the movement to the wire 70, temporarily. According to this, the upward movement of the vertical movement member 80, which tends to rotate the rotational movement link 110 in a counter clockwise direction, is delayed, temporarily.

In the meantime, the connector assembly 20 includes an outer connector 21 of a plastic coupled to the rotor 7*b*, and an inner connector 25 inside of the outer connector and coupled to the washing shaft 4. The inner connector 25 has a first serration 26 formed in an inside surface thereof coupled to a lower surface of the washing shaft 4, and a second serration 27 in an outside surface thereof exposed to outside of the outer connector 21 for coupling with the serration 37 in the movable slider 35. It is preferable that the inner connector is formed of sintered aluminum alloy for securing an adequate strength.

Figure 3A:
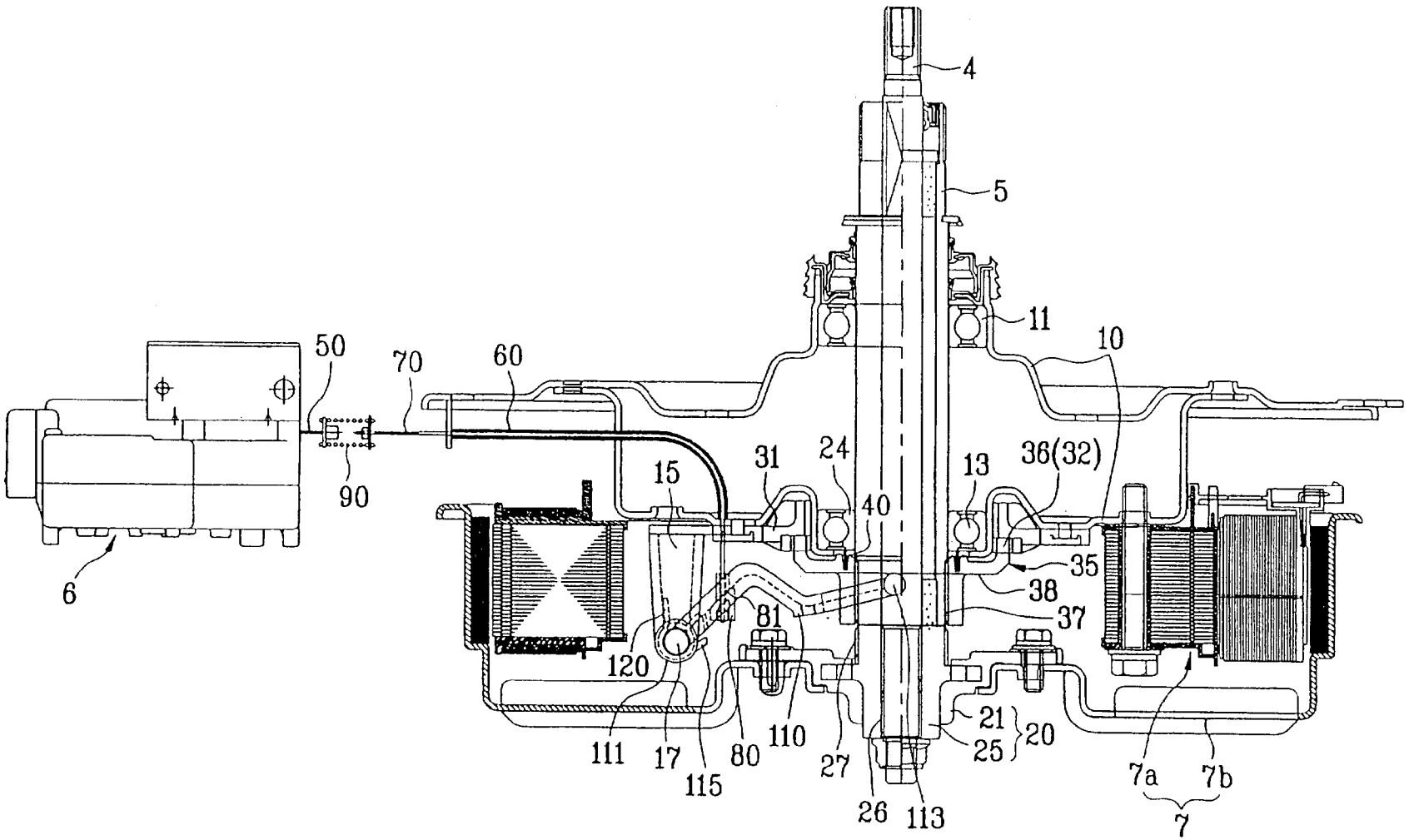
FIG. 3A illustrates a section showing operation of the power switching device in FIG. 2 in washing.
Figure 3B:
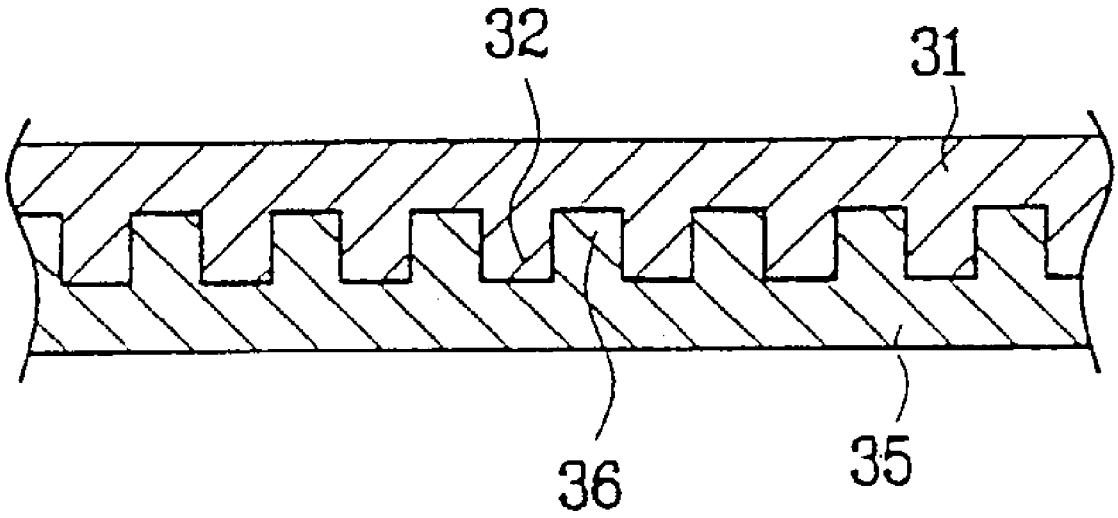
FIG. 3B illustrates a section showing an enlarged view of a slider in the power switching device in FIG. 3A.

The operation of the washing machine in accordance with a first preferred embodiment of the present invention will be explained. FIGS. 3A and 3B illustrate a washing cycle of the washing machine of the present invention.

Referring to FIG. 3A, upon application of power to the actuator 6, the connecting rod 50 pulls the wire 70. In this instance, the buffer spring 90 transmits a pulling force from the connecting rod 50 to the wire 70 without any particular deformation. In this instance, the other end of the wire 70 moves up guided by the wire guide 60.

On the same time with this, the upper end 81 of the vertical movement link 80 moves up along the body of the rotational movement link.

According to this, the rotational movement link 110 rotates around the fixing pin 17 in a counter clockwise direction, so that the movable slider 35 in contact with the other end 113 of the rotational movement link moves up along the spinning shaft 5. The upward movement of the movable slider 35 is continued until the movable gear 36 engages with the stationary gear 32 perfectly, which state is shown in FIG. 3B.

In this instance, the movable slider 35 is decoupled from the inner connector 25 completely. That is, the serration 37 in the movable slider 35 is only coupled to the outside surface of the spinning shaft 5, but separated from the second serration 27 in the inner connector.

In this state, the rotating force of the rotor 7*b* is transmitted to the washing shaft 4 only. Accordingly, since only the pulsator coupled with the washing shaft 4 is rotated, the washing cycle is carried out.

Figure 4A:
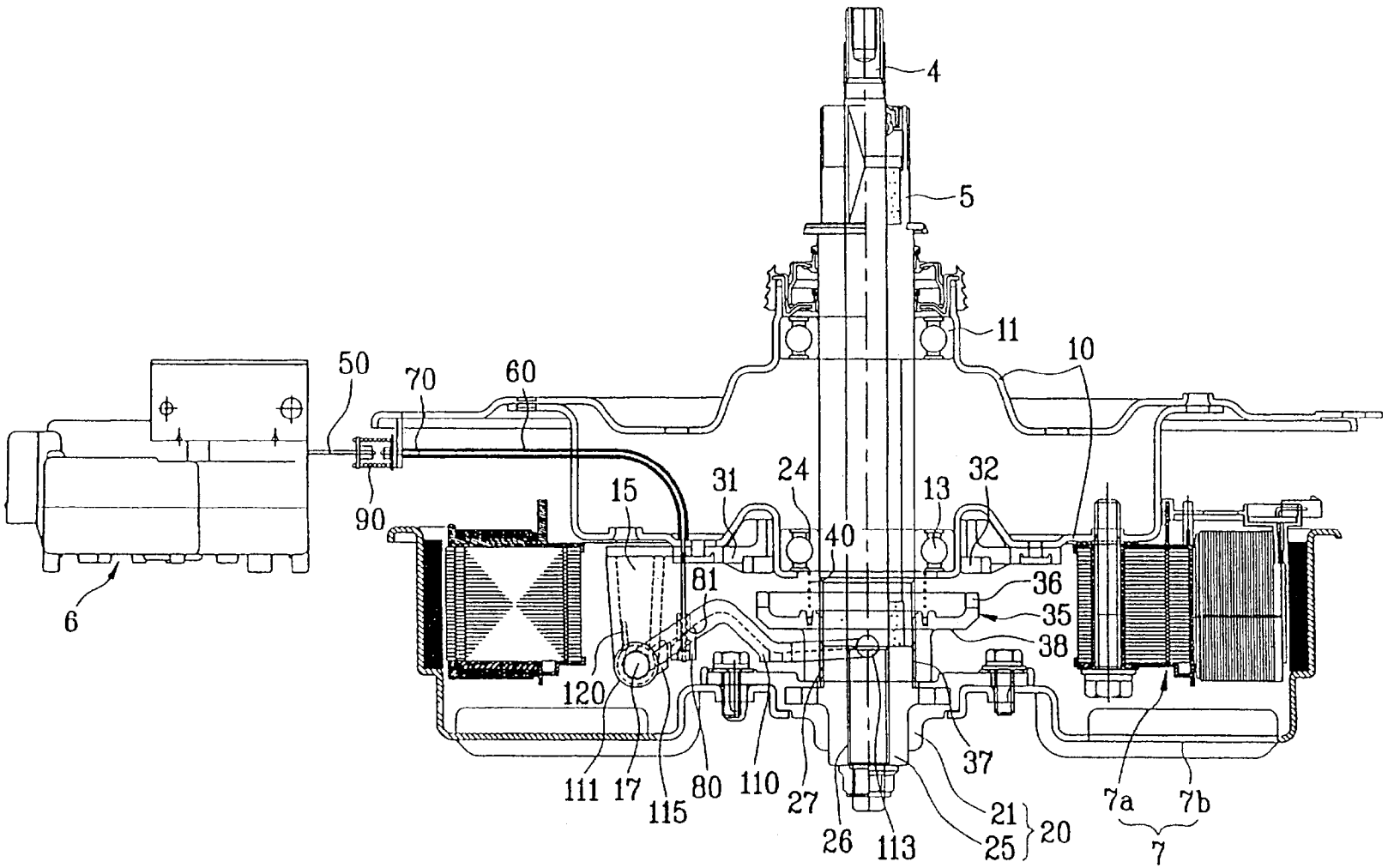
FIG. 4A illustrates a section showing operation of the power switching device in FIG. 2 in spinning.
Figure 4B:
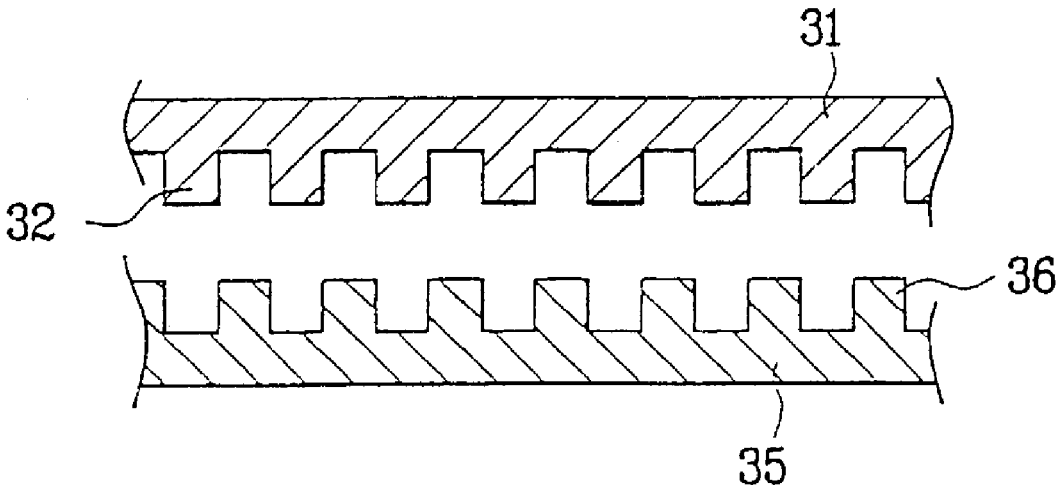
FIG. 4B illustrates a section showing an enlarged view of a slider in the power switching device in FIG. 4A.

Next, FIGS. 4A and 4B illustrate a spinning cycle of the washing machine of the present invention.

Referring to FIG. 4A, as the power to the actuator 6 is cut off, the force of the connecting rod 50 pulling the wire 70 is removed. According to this, the vertical movement link 80 moves down by gravity, and, as a result, the force of the vertical movement member 80 supporting the rotational movement link 110 is removed, too.

As a result, the rotational movement link 110 rotates around the fixing pin 17 in the clockwise direction by restoring force of the torsion spring 120. The rotational movement link 110 rotates to an angle the rotational movement link 110 comes into contact with the stopper 115.

On the same time with this, the movable slider 35 moves down along the spinning shaft 5 by gravity and the restoring force of the compression spring 40 as the supporting force of the rotational movement link 110 is removed. The movable slider 35 moves down until the movable slider 35 comes into contact with the other end 113 of the rotational movement link 110. As a result, the stationary gear 32 and the movable gear 36 are disengaged completely as shown in FIG. 4.

In this instance, the movable slider 35 is coupled both to the spinning shaft 5 and the inner connector 25. That is, the serration 37 of the movable slider is engaged both to the outside surface of the spinning shaft 5 and the second serration 27 of the inner connector.

In this state, the rotating force of the rotor 7*b* is transmitted, not only to the washing shaft 4, but also to the spinning shaft 5 through the movable slider 35. According to this, a spinning cycle is carried out as the pulsator coupled to the washing shaft 4 and the washing tub coupled to the spinning shaft 5 rotate.

Figure 5A:
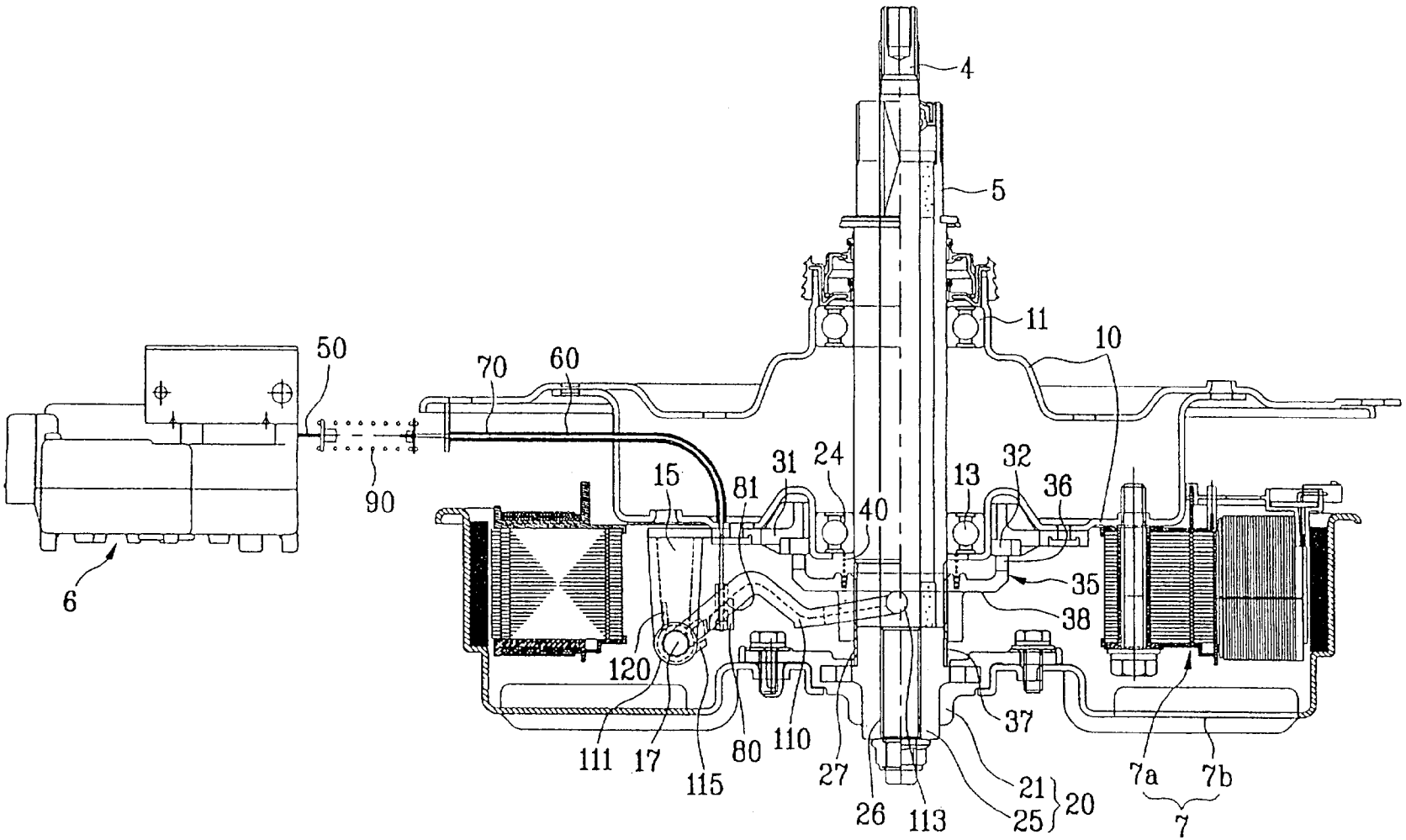
FIG. 5A illustrates a section showing operation of the power switching device in FIG. 2 in seizure.
Figure 5B:
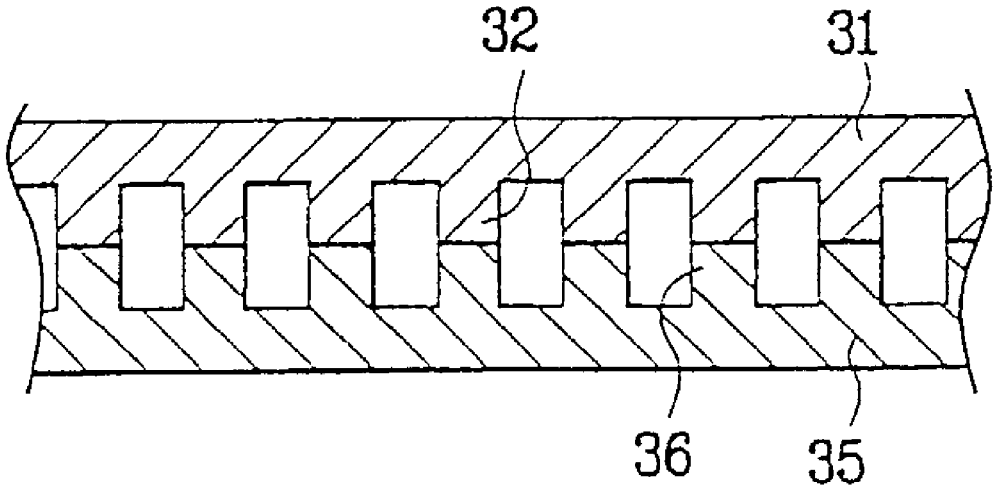
FIG. 5B illustrates a section showing an enlarged view of a slider in the power switching device in FIG. 5A.

Next, FIGS. 5A and 5B illustrate a seizure state of the washing machine of the present invention.

Referring to FIG. 5A, a power is provided to the actuator 6 for carrying out a washing cycle, and the movable slider 35 moves up supported by the rotational movement link 110 through a process as described before. In this instance, since the movable slider 35 is in a state the movable slider 35 is rotated with the spinning shaft 5, there may be a state the movable gear 36 and the stationary gear 32 are engaged, as shown in FIG. 5B.

In this instance, while the connecting rod 50 keeps pulling the wire 70, the vertical movement member 80 can move up no more as the rotational movement link 110 is stopped by the movable slider 35. According to this, the buffer spring 90, extended by the force of the connecting rod 50, absorbs the force of the connecting rod temporarily, permitting to remove the force of the rotational movement link 110 tending to move the movable slider 35 upward forcibly, temporarily.

In this instance, the movable slider 35 is in a state the movable slider 35 is coupled with the inner connector 25. Therefore, when the rotor 7*b* rotates, the movable slider 35 also rotates together with the rotor 7*b*, and when the movable slider 35 rotates, there is a moment the movable gear 36 and the stationary gear 32 are engaged normally, when the buffer spring 90, restoring to an original state, pulls the wire 70, to move the vertical movement member 80 up, and, as a result, the movable slider 35 moves up as the rotational movement link 110 rotates in a counter clockwise direction. This operation is progressed until the movable gear 36 and the stationary gear 32 are engaged perfectly, so as to release the momentary seizure state.

A washing machine in accordance with a second preferred embodiment of the present invention will be explained with reference to FIGS. 6A–6C. The washing machine in accordance with a second preferred embodiment of the present invention is identical to the washing machine in accordance with a first preferred embodiment of the present invention, except that additional coating layers are formed for improving mechanical characteristics and reducing noise when the stationary slider and the movable slider are engaged. Therefore, explanations of parts other than the coating layers will be omitted.

Figure 6A:
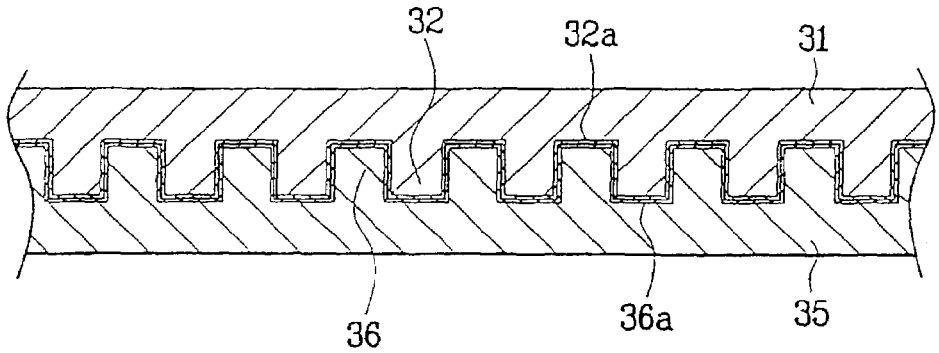
FIGS. 6A, 6B, and 6C illustrate sections showing enlarged views of sliders in a power switching device in a washing machine in accordance with a second preferred embodiment of the present invention during washing, spinning, and seizure, respectively.
Figure 6B:
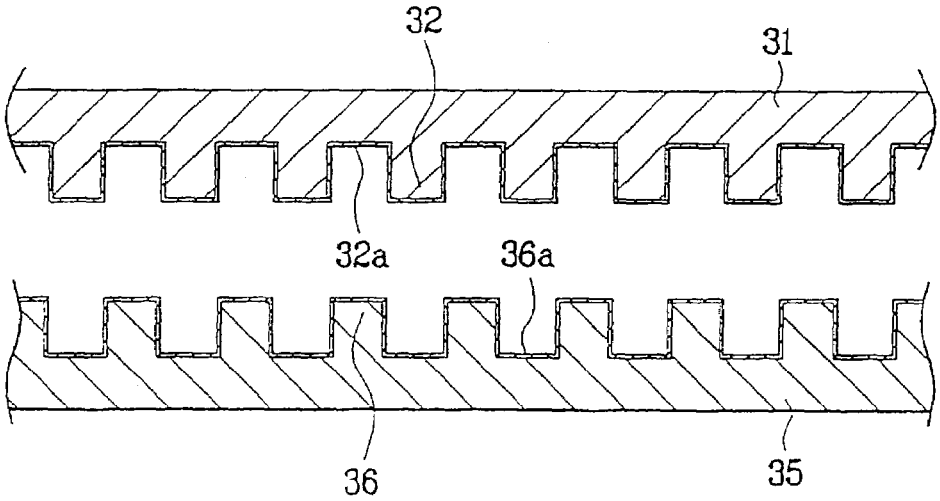
Figure 6C:
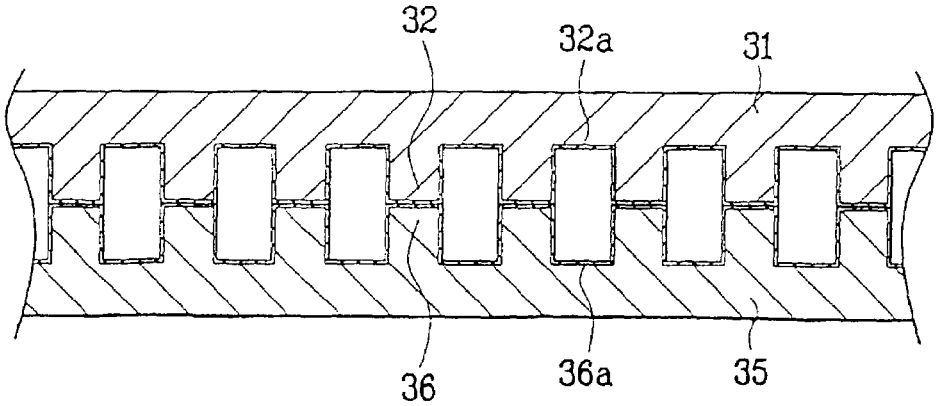

Referring to FIGS. 6A–6C, a molybdenum coated layer 32*a*, or 36*a* is formed on the stationary gear 32 of the stationary slider 31 and the movable gear 36 of the movable slider 35. Since the stationary gear 32 and the movable gear 36 are parts that will repeat engagement/disengagement, the stationary gear 32 and the movable gear 36 can not but be susceptible to wear and thermal deformation caused by friction. Therefore, by applying the molybdenum coating layer 32*a*, and 36*a* to the stationary gear 32 and the movable gear 36, corrosion resistance, heat resistance, abrasion resistance, and the like, of the stationary gear 32 and the movable gear 36 are improved.

It is preferable that the molybdenum coating layers are formed of molybdenum disulfide as a main composition. Because the excellent self lubricating ability of the molybdenum disulfide can reduce mechanical wear of the stationary gear 32 and the movable gear 36 substantially, as well as noise caused by the friction.

In the meantime, instead of a type in which the serration is formed in a lower end part of the washing shaft 4, and the inner connector 25 is coupled with the serration, a type may be applied in which the lower end part of the washing shaft 4 is formed to be square, and the inner connector 25 is formed to be a hollow square ring to be coupled with the square shaft.

It will be apparent to those skilled in the art that various modifications and variations can be made in the washing machine of the present invention without departing from the spirit or scope of the invention. Thus, it is intended that the present invention cover the modifications and variations of this invention provided they come within the scope of the appended claims and their equivalents.

INDUSTRIAL APPLICABILITY

As has been explained, the washing machine of the present invention can switch driving power of a motor between a washing shaft and a spinning shaft within a short time through a linkage.

Moreover, the washing machine of the present invention can reduce noise caused during power switching, and improve mechanical performance of the power switching device, by means of molybdenum coating layer.

What is claimed is:

1. A washing machine comprising:

a motor having a stator, and a rotor rotatable by a current induced from the stator;

a hollow spinning shaft having an upper end coupled with a washing tub;

a washing shaft rotatably disposed in a hollow part of the spinning shaft, having an upper end coupled with a pulsator in the washing tub;

a connector assembly between the rotor and the washing shaft for transmission of a rotating force from the rotor to the washing shaft;

a slider configured to move in upward and downward directions along an outside surface of the spinning shaft for selective transmission of a rotating force from the rotor to the spinning shaft;

an actuator coupled with the slider, the actuator configured to move the slider in an upward and downward direction;

a rotational movement link;

a vertical movement member coupled with the rotational movement link, wherein the rotational movement link and the vertical movement member are disposed between the actuator and the slider for transmitting power from the actuator to the slider; and means between the actuator and the slider for delaying the power from the actuator to the slider.

2. A washing machine as claimed in claim 1, wherein the slider includes:

a stationary slider fixed to a lower part of a bearing housing under the washing tub, having a stationary gear formed along an outside circumference thereof; and a movable slider coupled to the linkage to be movable in up and down directions, having a serration in an inside surface for selective coupling with the spinning shaft or the connector assembly, and a movable gear on an outside surface fit to the stationary gear.

3. A washing machine as claimed in claim 2, further comprising a compression spring between the movable slider and the stationary slider having a restoring force such that the movable slider and the stationary slider do not couple.

4. A washing machine as claimed in claim 2, wherein the connector assembly includes:

an outer connector connected to the rotor and;

an inner connector inside of the outer connector having a first serration in an inside thereof for coupling with a lower surface of the washing shaft, and a second serration in an outside surface exposed outside of the outer connector for coupling with the serration in the movable slider.

5. A washing machine as claimed in claim 4, wherein the inner connector has an aluminum sintered body.

6. A washing machine as claimed in claim 2, further comprising:

a wire guide bent in a '⌉' form fixed to the bearing housing;

a wire inserted inside of the wire guide having one end connected to the connecting rod for transmission of linear movement of the actuator, wherein the vertical movement member is connected to the other end of the wire having a sloped upper end for moving up and down according to a linear movement of the actuator, and the rotational movement link having one end hinge coupled to a fixing pin coupled to one side of the bearing housing, the other end in contact with the movable slider, and a body between the one end and the other end in surface to surface contact with the sloped surface of the vertical movement member, for rotating around the fixing pin when the vertical movement member moves up and down.

7. A washing machine as claimed in claim 6, further comprising a torsion spring inserted on an outside surface of the fixing pin, having one fixed end, and the other end connected to the rotational movement link, for assisting return of the rotational movement link when the actuator is turned off.

8. A washing machine as claimed in claim 6, further comprising a stopper fitted so as to come into contact with the rotational movement link for limiting a rotation angle of the rotational movement link, to limit a moving down position of the movable slider when the actuator is turned off.

9. A washing machine as claimed in claim 6, wherein the means is disposed between the connecting rod and the wire, for transmission of movement of the connecting rod to the wire as it is, and absorbing the movement of a pulling force of the connecting rod as the means extends under a state the stationary gear and the movable gear are miss engaged.

10. A washing machine as claimed in claim 1, further comprising a molybdenum coating layer on each contact surface of the stationary gear and the movable gear for improving corrosion resistance, heat resistance, and abrasion resistance of the stationary gear and the movable gear.

11. A washing machine as claimed in claim 3, wherein the molybdenum coating layer has molybdenum disulfide as a main composition.

* * * * *